US010040528B2

(12) United States Patent
Song et al.

(10) Patent No.: US 10,040,528 B2
(45) Date of Patent: Aug. 7, 2018

(54) PROPULSION DEVICE FOR SHIP

(71) Applicant: SAMSUNG HEAVY IND. CO., LTD., Seoul (KR)

(72) Inventors: Chi Su Song, Geoje-si (KR); Jaeouk Roh, Geoje-si (KR); Semyun Oh, Geoje-si (KR); Donghyun Lee, Geoje-si (KR); Jaekwon Jung, Geoje-si (KR); Kwangkun Park, Geoje-si (KR); Hyoung-Gil Park, Geoje-si (KR); Kwangjun Paik, Geoje-si (KR); Jeunghoon Lee, Geoje-si (KR); Jinsuk Lee, Geoje-si (KR); Taegoo Lee, Geoje-si (KR)

(73) Assignee: Samsung Heavy Ind. Co., Ltd. (KR)

( * ) Notice: Subject to any disclaimer, the term of this patent is extended or adjusted under 35 U.S.C. 154(b) by 294 days.

(21) Appl. No.: 14/765,952

(22) PCT Filed: Feb. 10, 2014

(86) PCT No.: PCT/KR2014/001085

§ 371 (c)(1),
(2) Date: Aug. 5, 2015

(87) PCT Pub. No.: WO2014/123397

PCT Pub. Date: Aug. 14, 2014

(65) Prior Publication Data

US 2015/0360760 A1 Dec. 17, 2015

(30) Foreign Application Priority Data

Feb. 8, 2013 (KR) ..... 10-2013-0014232
Sep. 27, 2013 (KR) ..... 10-2013-0115287
Feb. 7, 2014 (KR) ..... 10-2014-0014302

(51) Int. Cl.
*B63H 5/15* (2006.01)
*B63H 5/14* (2006.01)
(Continued)

(52) U.S. Cl.
CPC ..... *B63H 5/15* (2013.01); *B63B 35/68* (2013.01); *B63H 5/08* (2013.01); *B63H 5/10* (2013.01);
(Continued)

(58) Field of Classification Search
CPC ... B63H 5/08; B63H 5/10; B63H 5/14; B63H 5/15; B63H 5/125; B63H 2005/103;
(Continued)

(56) References Cited

U.S. PATENT DOCUMENTS 1,363,660 A * 12/1920 La Fleur ..... B63H 1/20 416/200 R
1,944,525 A * 1/1934 Medina y Pereyra ... B63H 5/10 416/200 R
(Continued)

FOREIGN PATENT DOCUMENTS

DE 2540596 A1 * 4/1976 ..... B63H 5/14
EP 0 406 451 7/1993
(Continued)

OTHER PUBLICATIONS

Extended European Search Report for Application No. EP 14 74 9497 dated Aug. 26, 2016 (10 pages).

*Primary Examiner* — Mark Laurenzi
*Assistant Examiner* — Xiaoting Hu
(74) *Attorney, Agent, or Firm* — Harness, Dickey & Pierce, P.L.C.

(57) ABSTRACT

A propulsion device for a ship is introduced. The propulsion device for the ship comprises a duct having a nose corresponding to the front vertex of a hydrofoil cross-section and
(Continued)

a tail corresponding to the rear vertex of the hydrofoil cross-section, wherein the shape of the duct cross-section comprises: an outer surface formed upward in a convex shape at the front end of the duct and formed downward in a concave shape at the rear end of the duct; an inner front part of the duct formed downward in a convex shape at the front end of the duct; an inner rear part of the duct formed downward in a convex shape at the rear end of the duct; and a parallel part for connecting the inner forward part and the inner backward part in parallel to each other.

11 Claims, 18 Drawing Sheets

(51) Int. Cl.

| | |
|---|---|
| ***B63H 5/125*** | (2006.01) |
| ***B63H 1/28*** | (2006.01) |
| ***B63B 35/68*** | (2006.01) |
| ***B63H 5/08*** | (2006.01) |
| *B63H 5/10* | (2006.01) |
| *B63B 35/66* | (2006.01) |

(52) U.S. Cl.
CPC ..... *B63H 5/125* (2013.01); *B63H 5/14* (2013.01); *B63B 35/66* (2013.01); *B63H 2001/283* (2013.01); *B63H 2005/103* (2013.01); *B63H 2005/1254* (2013.01)

(58) Field of Classification Search
CPC ..... B63H 2005/106; B63H 2005/1254; B63H 2001/283; B63B 35/66; B63B 35/68
See application file for complete search history.

(56) References Cited

U.S. PATENT DOCUMENTS

| | | | | |
|---|---|---|---|---|
| 5,766,047 | A * | 6/1998 | Alexander, Jr. ..... | B63H 5/10 416/129 |
| 5,799,394 | A * | 9/1998 | Rice ..... | B63H 5/14 29/889.1 |
| 2009/0010763 | A1* | 1/2009 | Watts ..... | B63H 1/26 416/223 R |
| 2013/0298816 | A1* | 11/2013 | Van Der Kam ..... | B63H 5/125 114/150 |

FOREIGN PATENT DOCUMENTS

| | | | | | |
|---|---|---|---|---|---|
| GB | 189158 | A * | 11/1922 | ..... | B63H 1/15 |
| GB | 2190344 | A | 11/1987 | | |
| GB | 2474818 | | 4/2011 | | |
| JP | 2-151593 | | 6/1990 | | |
| JP | 2001-516675 | | 10/2001 | | |
| JP | 2006-306304 | | 11/2006 | | |
| JP | 2010-234861 | | 10/2010 | | |
| KR | 1991-0700173 | | 3/1991 | | |
| KR | 2000-0018734 | | 10/2000 | | |
| KR | 10-2012-0098941 | | 9/2012 | | |
| KR | 10-2012-0100267 | | 9/2012 | | |
| KR | 20130090259 | A * | 8/2013 | | |
| RU | 2115588 | C1 * | 7/1998 | ..... | B63H 5/125 |
| RU | 2115589 | C1 * | 7/1998 | ..... | B63H 5/10 |
| WO | 99/14113 | | 3/1999 | | |
| WO | WO-2012-069164 | A2 | 5/2012 | | |
| WO | WO 2012173306 | A1 * | 12/2012 | ..... | B63H 5/10 |

* cited by examiner

PROPULSION DEVICE FOR SHIP

TECHNICAL FIELD

The present disclosure relates to a vessel propulsion apparatus, and more particularly to a vessel propulsion apparatus capable of reducing vortices left around a hub using blades of different sizes having a duct section adapted to characteristics of flows into the duct.

BACKGROUND ART

The growing interest in vessel maneuverability and propulsive efficiency results in a growing interest in main propulsion apparatus and auxiliary propulsion apparatus equipped in vessels. For example, a vessel like a drillship is equipped with an azimuth thruster for generating thrust in order to implement precise positioning or tow other vessels during high- or low-speed navigation.

There are two variants of azimuth thrusters, based on their use, that is, the open azimuth thrusters (for example, propellers) without a duct, and the ducted azimuth thrusters with a duct having an airfoil section around their propeller.

The aforementioned azimuth thrusters have a gear positioned in the hull capable of rotating in a horizontal direction to generate thrust in all azimuths, that is, omni-directional thrust. It is essential that a drill ship implements accurate DP (Dynamic Positioning) for drilling against environmental loads, for example, wave drift forces due to waves, external forces due to wind, and external forces due to tides.

Also, as the drillship employs an azimuth thruster as an auxiliary propulsion apparatus to go to drilling sites, general operational conditions of the azimuth thruster are also very important. If a great towing force is required in operation, generation of great towing forces depending on towing conditions is also very important.

In particular, vortices take place in the rear center of a propeller when it rotates, and lowers the pressure of fluid flowing into the propeller to generate forces in the direction of hull resistance, thereby reducing the propulsive efficiency of the propeller.

In relation to this, one prior art reference is Korea Laid-open Publication No. 10-2012-0098941, entitled "THRUSTER WITH DUCT ATTACHED AND VESSEL COMPRISING SAME".

In this prior art, because the sectional shape of the duct is located on the outer surface of the front end of the duct during high-speed navigation, the thruster has a portion expanding with a circular section outward from a standard airfoil to inhibit pressure change, and an open angle of which the direction of leading edge is widened to generate a predefined towing force in low-speed operation.

However, the prior art does not disclose the distance from the parallel portion on the inner side of the duct which is in parallel with the duct axis (e.g., X-axis or the axis of propeller rotation) to each of the nose and the tail. In the prior art, important design variables are not described about what numerical ranges the front portion and the rear portion in the parallel portion belong to on the basis of the position of thruster plane drawn by the rotating end of the propeller blade (plane Y-Z: the plane of propeller rotation). Therefore, the effect of the aforementioned important design variables on total thrust, the torque of a propeller and the exclusive efficiency of an entire thruster is not known. The aforementioned prior art document does not provide enough description to develop a propulsion apparatus that offers even higher propulsive efficiency, while implementing precise maneuverability and highly-efficient towing.

In addition, the prior art mentions just the outward expansion and the open angle of which the leading edge direction is widened, but does not describe any technology for reducing vortices taking place by propellers. In this context, it may be difficult to absorb the rotational component of propeller wake in the bollard condition in which just the propeller rotates at a rated RPM while a vessel or marine structure almost stands still.

DISCLOSURE

Technical Problem

In view of the above, an embodiment of the present disclosure provides a vessel propulsion apparatus for improving vessel operation performance, positioning performance and towing performance, and reducing vortices left around a hub in the bollard condition.

Technical Solution

In accordance with an aspect of the present disclosure, there is provided a vessel propulsion apparatus including: a duct having a nose as a front vertex of an airfoil section, and a tail as a rear vertex of the airfoil section, wherein the sectional shape of the duct includes: an outer surface formed convex upward at the front end of the duct, and formed concave downward at the back end of the duct; and an inner surface having an inner front portion of the duct formed convex downward at the front end of the duct, an inner rear portion of the duct formed convex downward at the back end of the duct, and a parallel portion seamlessly connecting the inner front portion of the duct with the inner rear portion of the duct.

In accordance with another aspect of the present disclosure, there is provided a vessel propulsion apparatus including: a hub arranged on and receiving power through a main shaft; main blades installed on the outer circumferential surface of the hub; sub-blades spaced and placed toward the back of the main shaft from the main blades and installed inclined toward the back of the main shaft; and a duct installed around the main blades, and having an airfoil section.

Advantageous Effects

The duct for propulsion apparatus in accordance with an embodiment of the present disclosure improves performance by improving flows around the duct. For example, the embodiment of the present disclosure may meet all of general operational conditions, positioning and towing conditions by optimizing first and second distances between the parallel portion on the inner side of the duct and the nose or the tail, and improve vessel operation performance, positioning and towing performance.

Further, the embodiment of the present disclosure has a parallel portion defined by the front portion and the rear portion thereof with reference to the position (propeller position) of the thruster plane (plane Y-Z) to improve thrust in the bollard condition. The parallel portion contributes to improving general operation performance while maximizing the performance of generating thrust in starting from the state of standstill, for example, ice jams, positioning performance in the state of standstill, or the performance of towing other vessels immobile in frozen seas.

Further, the embodiment of the present disclosure provides main blades and sub-blades for the hub to improve flows around the duct and the propeller to reduce vortices taking place by the propeller and also torque required to rotate the propeller, improving propulsive efficiency.

In addition, the embodiment of the present disclosure improves thrust in the bollard condition to effectively reduce vortices left around the hub and also the torque of the main shaft to improve propulsive efficiency.

BEST MODE

Hereinafter, the embodiments of the present invention will be described in detail with reference to the accompanying drawings. In the following description, when the detailed description of the relevant known function or configuration is determined to unnecessarily obscure the important point of the present invention, the detailed description will be omitted.

A comparative example against an embodiment of the present disclosure employs a standard airfoil, which is a marine 19A airfoil (hereinafter, referred to as a comparative example) generally used because of its high manufacturability for the duct of the ducted azimuth thrusters.

Figure 1:
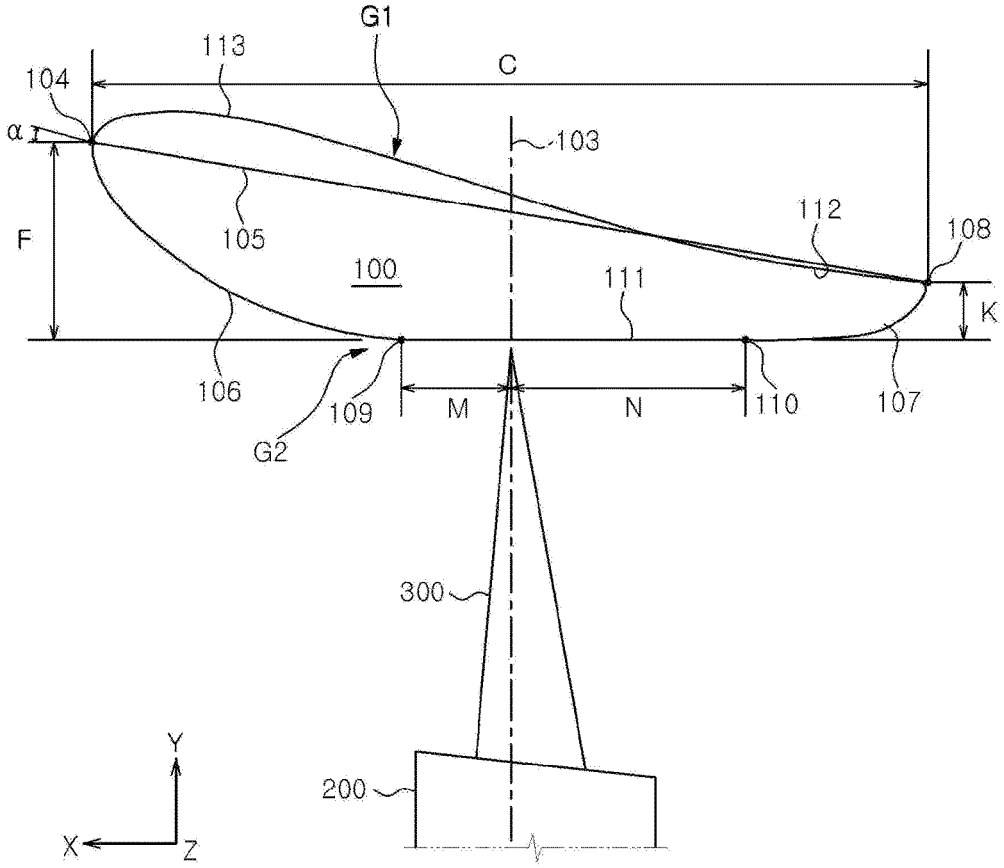
FIG. 1 shows an exemplary duct of a propulsion apparatus in accordance with a first embodiment of the present disclosure.
Figure 2:
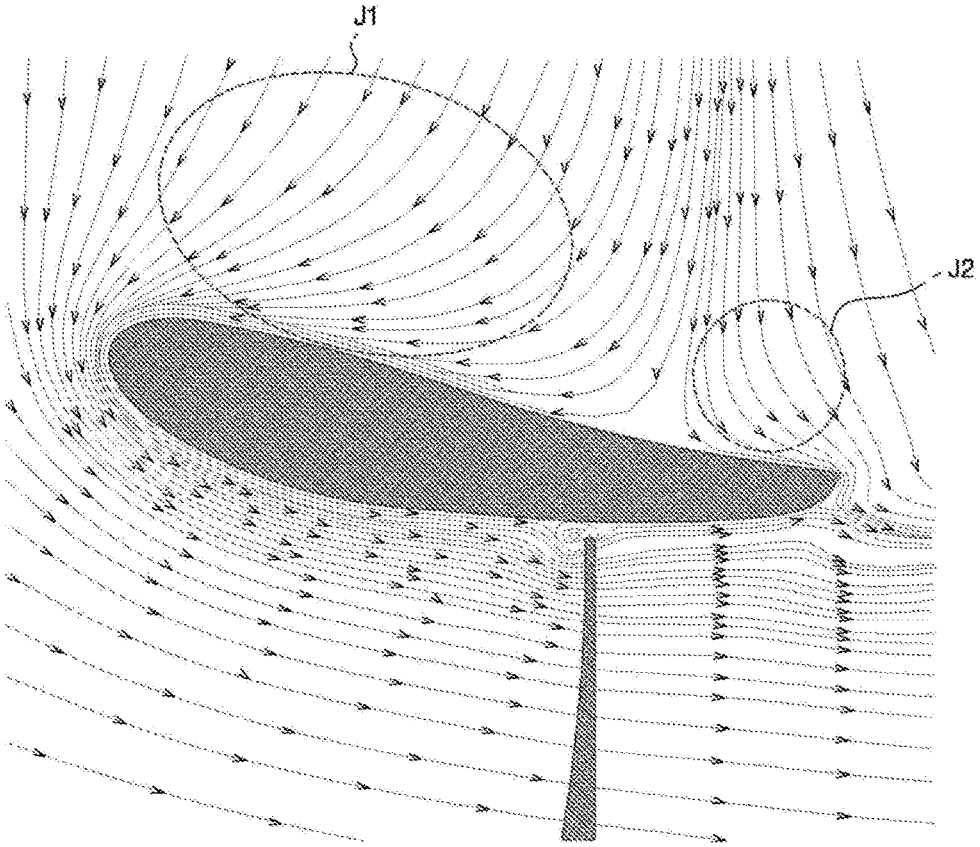
FIG. 2 shows a flow line distribution obtained with 2-dimensional CFD (Computational Fluid Dynamics) of the duct shown in FIG. 1.

FIG. 1 shows an exemplary duct of a propulsion apparatus in accordance with a first embodiment of the present disclosure, and FIG. 2 shows a flow line distribution obtained with 2-dimensional CFD (Computational Fluid Dynamics) of the duct shown in FIG. 1.

Referring to FIG. 1, the propulsion apparatus in accordance with the first embodiment includes a hub 200 receiving power through the gear case and the rotary shaft in the hull, a propeller 300 composed of a plurality of blades arranged along the outer circumferential surface of the hub 200, and a ring-shaped duct 100 around the propeller 300.

The sectional shape of the duct 100 may be the same along the entire circumference of the duct 100 with reference to the rotation axis (X-axis) of the propeller 300.

For example, in terms of the sectional shape, the duct 100 may include an outer surface G1 and an inner surface G2 of the duct 100 having optimized design variables to improve the efficiency of the ducted propulsion apparatus in consideration of operation characteristics of vessels, for example, drill ships or marine structures, and characteristics of positioning vessels and towing other vessels immobile in frozen seas.

In the sectional shape, the duct 100, which has an airfoil section to generate lift in accordance with the Bernoulli's theorem, may include: a nose 104 which is a front vertex of the airfoil section of the duct 100; a tail 108 which is a rear vertex of the airfoil section; and a chord line 105 which is a straight line segment connecting the nose 104 with the tail 108.

In the sectional shape, the duct 100 may include an outer surface G1 having a front portion 113 formed convex above the front end of the chord line 105, and a rear portion 112 formed concave below the back end of the chord line 105.

The front portion 113 of the outer surface G1 of the duct 100 may be a curved surface from the point where the chord line 105 meets the outer surface G1 of the duct 100 to the nose 104.

In addition, the rear portion 112 of the outer surface G1 of the duct 100 may be a curved surface from the point where the chord line 105 meets the outer surface G1 of the duct 100 to the tail 108.

The front portion 113 and the rear portion 112 may be seamlessly connected each other at the point where the chord line 105 meets the outer surface G1 of the duct 100.

As described above, the front portion 113 of the outer surface G1 of the duct 100 is formed convex above the front end of the chord line 105.

Referring to FIG. 2, in the bollard condition, flow 'J1' in the front outer area shows a pattern of flowing towards the duct nose. Therefore, it is shown that the front portion of the outer surface of the duct formed convex above the chord line accelerates flows into the propeller. This effect of acceleration contributes to improving duct thrust and reducing propeller torque.

On the other hand, referring to FIG. 1 again, the rear portion 112 of the outer surface G1 of the duct 100 is formed concave below the back end of the chord line 105.

Referring to FIG. 2 again, in the bollard condition, flow 'J2' in the outer rear portion flows smoothly toward the duct tail, and vortices formed thereby around the tail improves duct thrust.

In addition, referring to FIG. 1, the sectional shape of the duct 100 may have an angle of attack a which is an angle between the rotation axis X of the propeller 300 and the chord line 105. In this case, the angle of attack a of the duct 100 may be any one angle in a range from 5 to 20 degrees.

Also, in the sectional shape, the duct 100 may include an inner surface G2 of the duct 100 composed of: a parallel portion 111 running parallel with the rotation axis (X-axis) of the propeller 300; an inner front portion 106 of the duct which is a curved surface gently projected from the start point 109 of the parallel portion 111 to the nose 104 in a range equivalent to a first distance F in the direction of Y-axis from the parallel portion 111 to the nose 104; and an inner rear portion 107 of the duct which is a curved surface gently projected from the end point 110 of the parallel portion 111 to the tail 108 in a range equivalent to a second distance K, in the direction of Y-axis from the parallel portion 111 to the tail 108, the second distance being smaller than the first distance F.

In addition, the parallel portion 111 has a front portion M and a rear portion N with reference to the position 103 of propeller plane (Y-Z-plane) that is a circular plane drawn when the propeller 300 rotates. The front portion M and the rear portion N of the parallel portion 111 are important duct design variables in consideration of all of vessel operational characteristics, and characteristics of vessel positioning and towing, and may be limited to % ranges (M/C and N/C) relative to the full length C to maximize thrust performance based on 3-dimensional (3D) CFD result.

Figure 3:
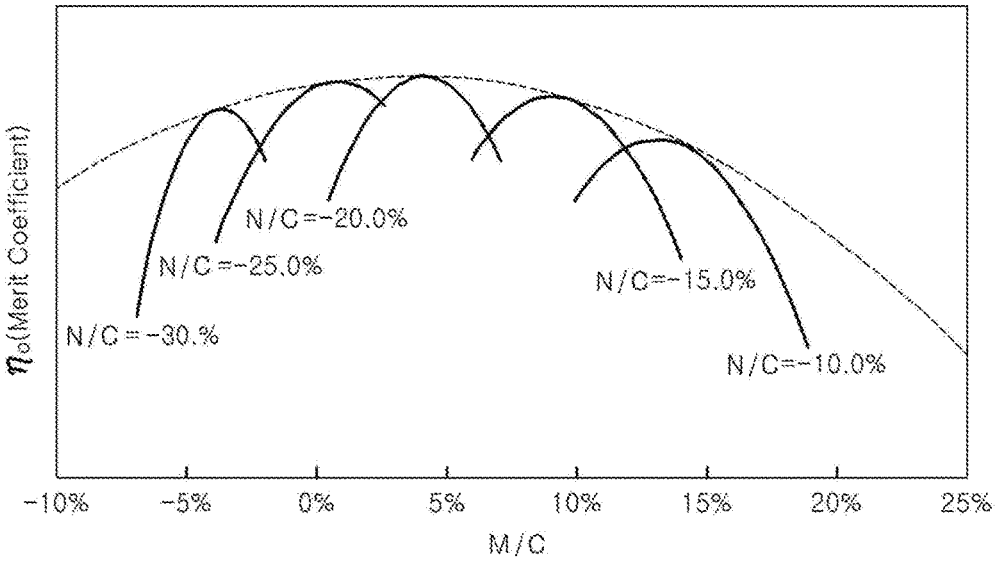
FIG. 3 shows a graph depicting the tendency of thruster efficiency change depending on the ranges of the front portion and the rear portion of the parallel portion relative to the full length with reference to the propeller plane position in the duct shown in FIG. 1.

FIG. 3 shows a graph depicting the tendency of thruster efficiency change depending on the ranges of the front portion and the rear portion of the parallel portion relative to the full length with reference to the position of a propeller plane in the duct shown in FIG. 1.

Referring FIGS. 1 and 3, there is shown a graph plotting thruster efficiency of the duct 100, $\eta_0$, (Merit coefficient) on the vertical axis in the bollard condition to identify positioning characteristics and towing characteristics of a vessel equipped with the propeller 300 by using 3D CFD, the range (M/C) of the front portion M of the parallel portion 111 relative to the full length C on the horizontal axis, and the range (N/C) of the rear portion N of the parallel portion 111 relative to the full length C (a plurality of curves in the graph).

In FIG. 3, thruster efficiency $\eta_0$ (Merit Coefficient) may be obtained with the following Equation 1 in consideration of the performance in towing or positioning conditions, for example, ducted propellers or azimuth-type propellers, as an important design condition.

While the exclusive efficiency [=KttJ/(2πKq)] of an entire thruster is obtained in the prior art described above, it is obtained with the following Equation 1 in this embodiment, in consideration of towing and positioning conditions with variables of propeller thrust, duct thrust, propeller torque, propeller diameter, propeller RPM (Revolution Per Minute), and the density of a fluid (for example, clean water).

$$\eta_0 = \frac{(K\pi/\pi)^{3/2}}{K_Q} \quad \text{[Equation 1]}$$

$$\text{where } K_\pi = K_{T\ propeller} + K_{T\ duct},$$

$$K_{T\ propeller} = \frac{T_P}{\rho \cdot n^2 \cdot D_P^4},$$

$$K_{T\ duct} = \frac{T_D}{\rho \cdot n^2 \cdot D_P^4}, \text{ and}$$

$$K_Q = \frac{Q}{\rho \cdot n^2 \cdot D_P^5}$$

In the above Equation 1, $\eta_0$ represents thruster efficiency (Merit Coefficient); $T_P$ does propeller thrust; $T_D$ does duct thrust; Q does propeller torque; $D_P$ does propeller diameter; n does propeller RPM; and ρ does the density of a fluid (for example, clean water).

Referring FIGS. 1 and 3, in the sectional shape, the duct 100 of this embodiment may include a front portion M of the parallel portion 111 with M/C in a range from −4.0% to 14.0% relative to the full length C from the position 103 of propeller plane, and a rear portion N of the parallel portion 111 with N/C in a range from −30.0% to −10.0% relative to the full length C from the position of propeller plane 103. In this case, figures with a minus sign (−) imply the minus (−) direction where the position 103 of the propeller plane is the origin in the axial direction (X-axis). That is, an M/C of −4.0% implies that the start point 109 of the parallel portion is away from the position 103 of propeller plane to the right by 4% of the full length C in FIG. 1. In this case, because the reference point of +/− for a direction of X-axis is the position 103 of propeller plane, changing the position of the installed duct 100 or installed propeller results in changing the position of the reference point although the duct is shaped the same. As a result, values of M/C and N/C change, and efficiency also changes.

In particular, a constant length of the parallel portion 111 close to the propeller 300 in the duct 100 may improve efficiency. Therefore, if M/C which is a ratio of the front portion M of the parallel portion 111 relative to the full length C is smaller than −4.0%, or N/C which is a ratio of the rear portion N of the parallel portion 111 relative to the full length C is greater than −10.0%, the parallel portion 111 is too short in length to result in insignificant improvement of efficiency.

Also, referring to FIG. 1, the first distance F from the parallel portion 111 to the nose 104 and the second distance K from the parallel portion 111 to the tail 108 are important duct design variables in consideration of all of vessel operation characteristics, and characteristics of vessel positioning and towing, and may be defined with the percentage ranges (F/C and K/C) relative to the full length C to maximize thrust performance based on 3D CFD result.

Figure 4:
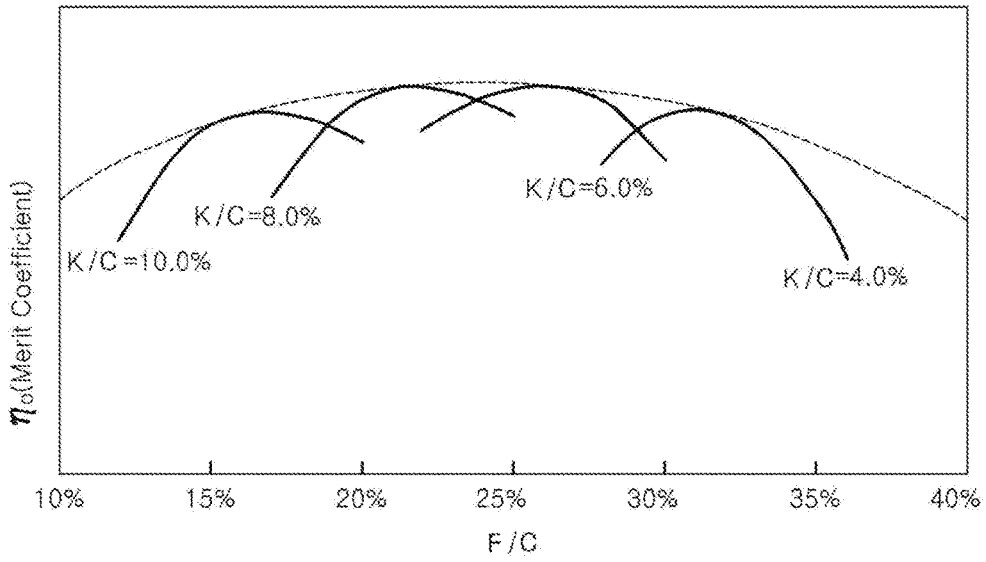
FIG. 4 shows a graph depicting the tendency of thruster efficiency change depending on the range of the first distance from the parallel portion to the nose relative to the full length, and the range of the second distance from the parallel portion to the tail relative to the full length in the duct shown in FIG. 1.

FIG. 4 shows a graph depicting the tendency of thruster efficiency change depending on the range for the first distance from the parallel portion to the nose relative to the full length, and the range for the second distance from the parallel portion to the tail relative to the full length in the duct shown in FIG. 1.

The vertical axis of the graph shown in FIG. 4 provides thruster efficiency $\eta_0$ (Merit Coefficient) in the bollard condition. The horizontal axis of the graph shown in FIG. 4 provides the percentage range (F/C) for the first distance F relative to the full length C. In addition, curves of the percentage range (K/C) for the second distance K relative to the full length C are provided in the graph.

Referring to FIGS. 1 and 4, the sectional shape of the duct 100 in this embodiment may include a first distance F from the parallel portion 111 to the nose 104, which has F/C in a range from 18.0% to 30.0% relative to the full length C, and a second distance K from the parallel portion 111 to the tail 108, which has K/C in a range from 4.0% to 10.0% relative to the full length C.

Figure 5:
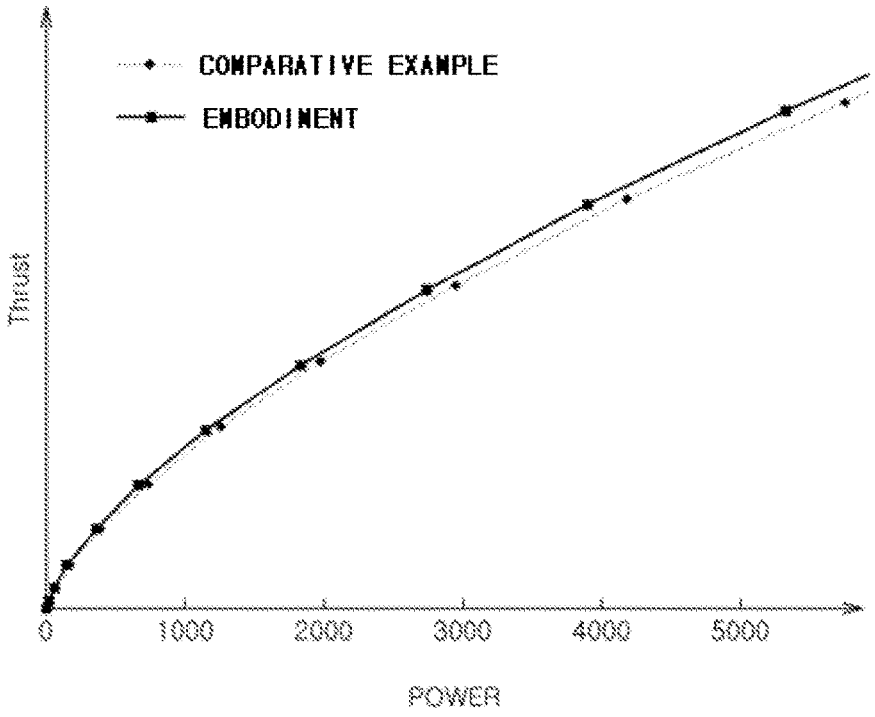
FIG. 5 shows a graph depicting a bollard performance curve (POWER-THRUST) between the duct shown in FIG. 1 and a comparative example.

FIG. 5 shows a graph depicting a bollard performance curve (POWER-THRUST) between the duct shown in FIG. 1 and the comparative example.

The airfoil section of the duct described above was used to derive the result shown in FIG. 5, and a marine 19A airfoil was used as a comparative example to compare bollard performance. The bollard performance curve (POWER-THRUST) for each airfoil section of this embodiment and the comparative example may be obtained through a model test (water bath test).

An examination of the aforementioned bollard performance curve (POWER-THRUST) reveals that the airfoil section of the duct in accordance with this embodiment improves thrust in the bollard condition by about 6.0% in comparison with the comparative example.

Figure 6:
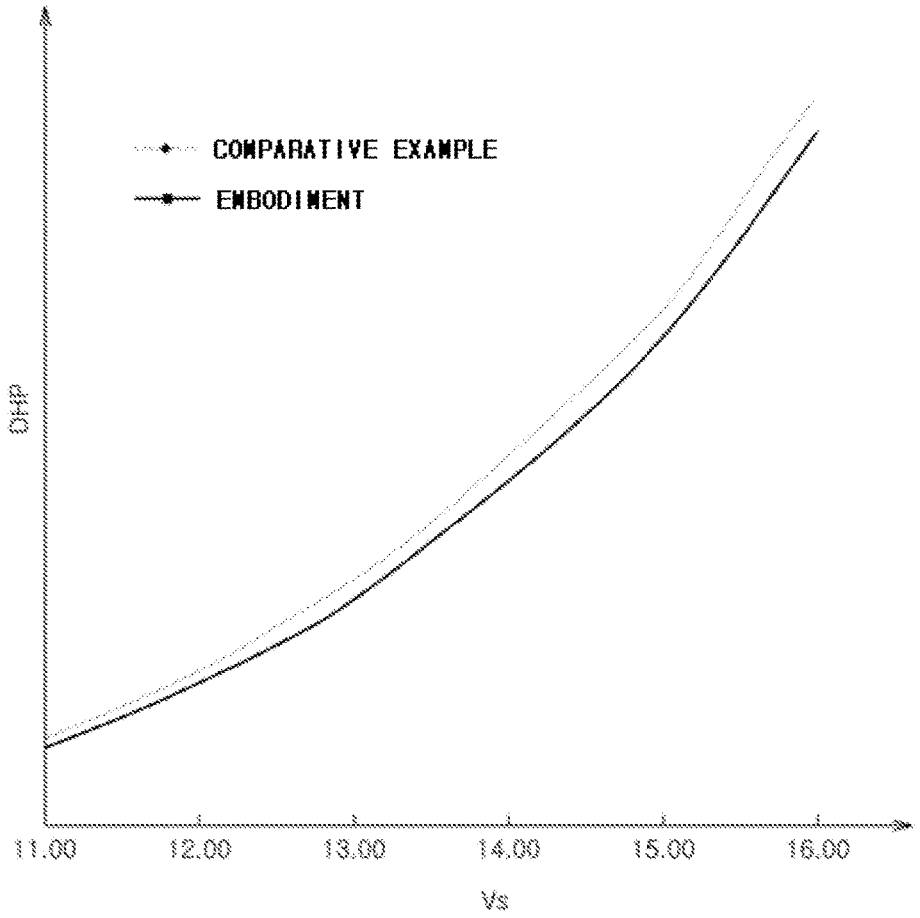
FIG. 6 shows a graph depicting curves for a correlation of linear velocity and required horsepower between the duct shown in FIG. 1 and the comparative example.

FIG. 6 shows a graph depicting curves for a correlation of linear velocity and required horsepower for the duct shown in FIG. 1 and the comparative example.

As shown from the curves for a correlation of the linear velocity and required horsepower for the comparative example and this embodiment shown in FIG. 6, improved performance is about 4.6% in normal operations.

For example, with the same delivered horsepower DHP, it is shown that this embodiment may achieve faster speed than the comparative example, or, with the same speed, may require smaller DHP than the comparative example to result in improved performance.

Figure 7:
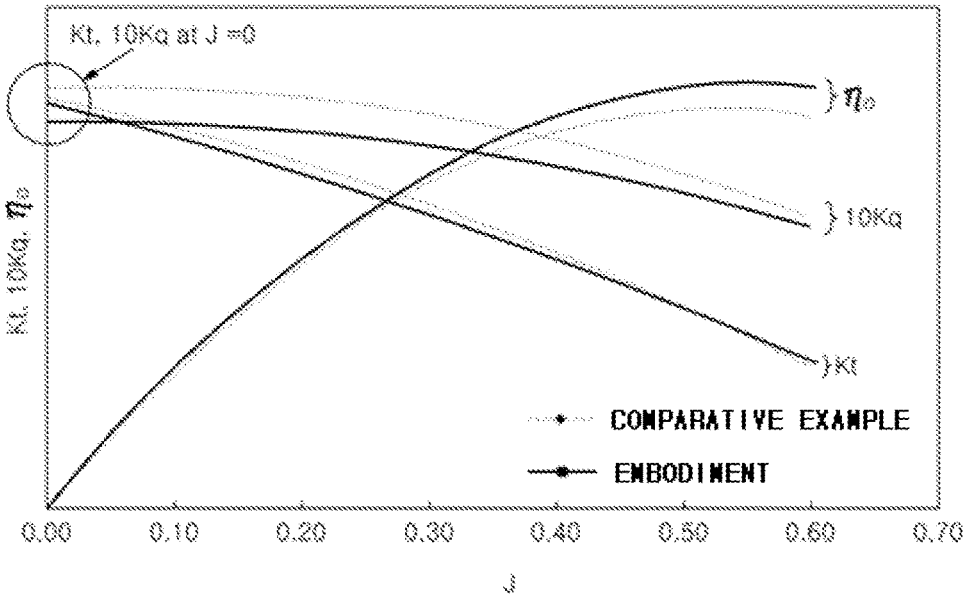
FIG. 7 shows a graph depicting curves for propulsion performance characteristics obtained through water bath test to compare and verify the performance of the duct shown in FIG. 1 and the comparative example.

FIG. 7 shows a graph depicting each propulsion performance characteristic curve for the duct shown in FIG. 1 and the comparative example obtained through water bath test to compare and verify the performance of the duct shown in FIG. 1 and the comparative example.

In the graph shown in FIG. 7, the horizontal axis provides the tendency of change for the thruster advance ratio J, and the vertical axis provides thrust Kt, torque 10 Kq and efficiency $\eta_O$.

Referring to FIG. 7, the duct of this embodiment reduces torque 10 Kq in all areas of the advance ratio J in comparison with the marine 19A airfoil of the comparative example.

In particular, the duct of this embodiment generates more thrust by about 6% (reduced Kq by about 7%, reduced Kt by about 1%) when the results of 10 Kq and Kt in the bollard area (e.g., at J=0) are used for calculation with the same engine horsepower. In the area of advance ratio J not smaller than 0.4 that represents a normal operational condition, exclusive efficiency $\eta_O$ is improved by 4.0% to 7.0%. That is, the increased attractive force of the duct contributes to increasing flows into the propeller, to result in reducing propeller torque 10 Kq and thus improving efficiency in all areas of the advance ratio J.

Figure 8:
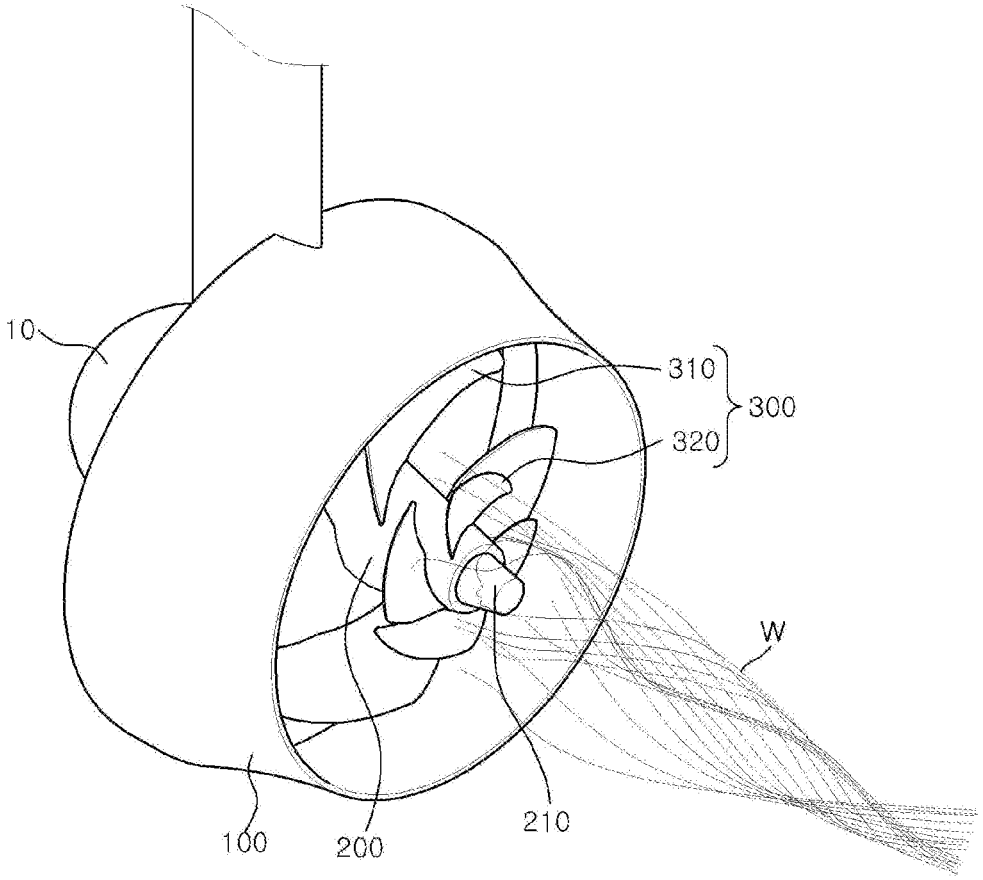
FIG. 8 is a perspective view showing a vessel propulsion apparatus in accordance with a second embodiment of the present disclosure.
Figure 9:
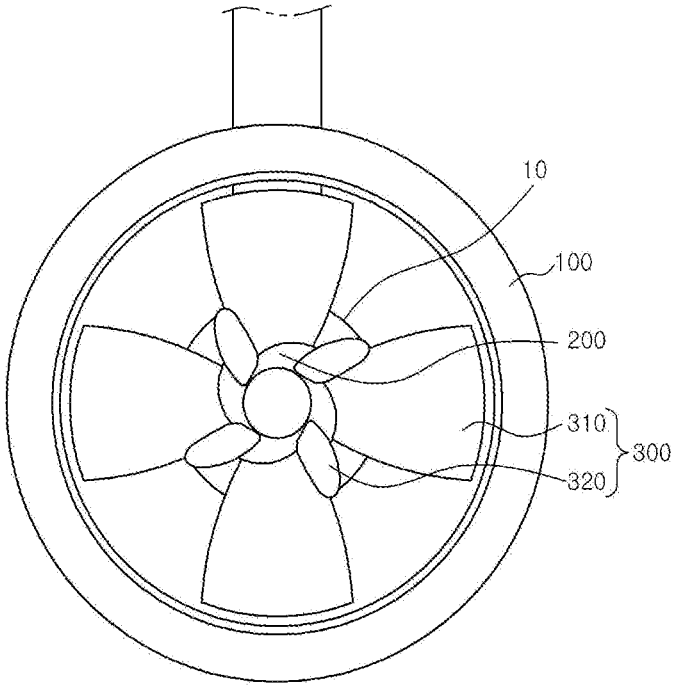
FIG. 9 is a front view showing the vessel propulsion apparatus in accordance with the second embodiment of the present disclosure.
Figure 10:
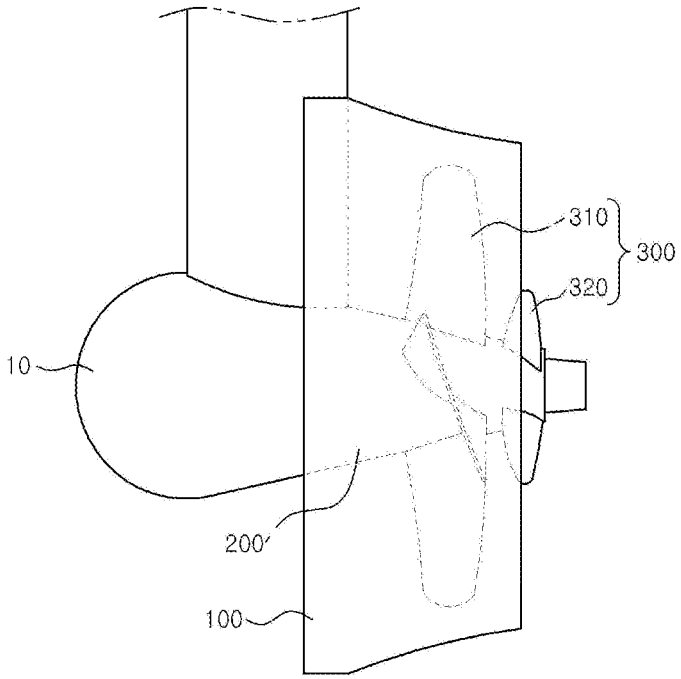
FIG. 10 is a side view showing the vessel propulsion apparatus in accordance with the second embodiment of the present disclosure.
Figure 11:
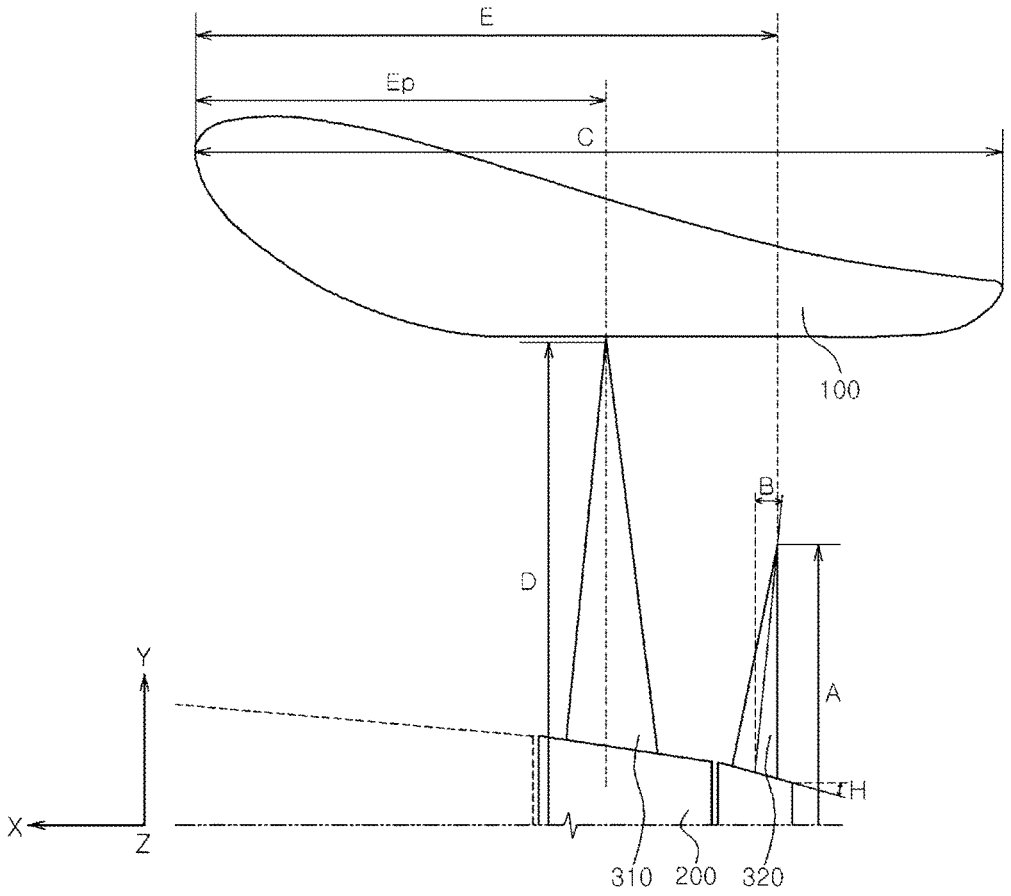
FIG. 11 shows an exemplary duct of the vessel propulsion apparatus in accordance with the second embodiment of the present disclosure.

FIG. 8 is a perspective view showing a vessel propulsion apparatus in accordance with a second embodiment of the present disclosure. FIG. 9 is a front view showing the vessel propulsion apparatus in accordance with the second embodiment of the present disclosure. FIG. 10 is a side view showing the vessel propulsion apparatus in accordance with the second embodiment of the present disclosure, and FIG. 11 shows an exemplary duct of the vessel propulsion apparatus in accordance with the second embodiment of the present disclosure.

Referring to FIGS. 8 to 11, the propulsion apparatus in accordance with the second embodiment may include a hub 200 receiving power through the main shaft of the hull (not shown), a propeller 300 including main blades 310 and sub-blades 320 installed around the outer circumferential surface of the hub 200, and a duct 100 installed to surround the circumference of the propeller 300.

Specifically, the hub 200 is coupled with the gear case 10 in which the main shaft of the hull is built in to be rotatable by means of the main shaft, and receives power from the main engine (not shown) of the hull through the main shaft to provide thrust to the propeller 300.

The hub 200 may be tapered toward the back of the propulsion apparatus with its radius gradually being reduced, and the back end of the hub 200 may be coupled with a cap 210. The cap 210 is tapered backward to smoothly pass the fluid through the propeller 300 along the side thereof.

The propeller 300 may be installed on the outer circumferential surface of the hub 200 for effectively reducing vortices W left around the hub 200.

The propeller 300 may include the main blades 310 and the sub-blades 320 spaced and arranged along the axial direction (x-axis) of the main shaft on the outer surface of the hub 200.

The main blades 310 may be a plurality of wings spaced and arranged in the radial direction on the front outer circumferential surface of the hub 200. The main blades 310 may have an airfoil section, and the shape and the number of main blades may be varied depending on thruster efficiency, cavitation resulting from loads and the surrounding environment.

The sub-blades 320 may be a plurality of wings spaced and arranged in the radial direction on the rear circumferential surface of the hub 200 spaced toward the back of the main shaft from the main blades 310, to be disposed alternately with the main blade 310. However, the sub-blade 320 may be installed anywhere, for example, on the cap 210 or in the space between the hub 200 and the cap 210, as well as the hub 200, provided that the location is spaced toward the back of the main shaft from the main blade 310.

The sub-blades 320 may be composed of wings smaller than the main blades 310, and be installed inclined toward the back of the main shaft. In this case, installation inclined toward the back means that the back end rather than the front end of the sub-blades 320 is positioned in the back of the main shaft.

Since the aforementioned sub-blades 320 may absorb rotational components in the condition of low advance ratios like the bollard condition in which just the propeller rotates at a rated RPM, it may effectively reduce vortices W left around the hub 200 and also improve propulsive efficiency by the reduced torque of the hub 200.

For example, the sub-blades 320 may have an inclination angle B inclined in a range from 0.1 to 27 degrees toward the back of the main shaft from the vertical direction of the main shaft. The hub 200 may have an inclination angle H inclined in a range from 0.1 to 27 degrees toward the axial direction ((−)X-axis) of the main shaft on the outer surface thereof.

Figure 12:
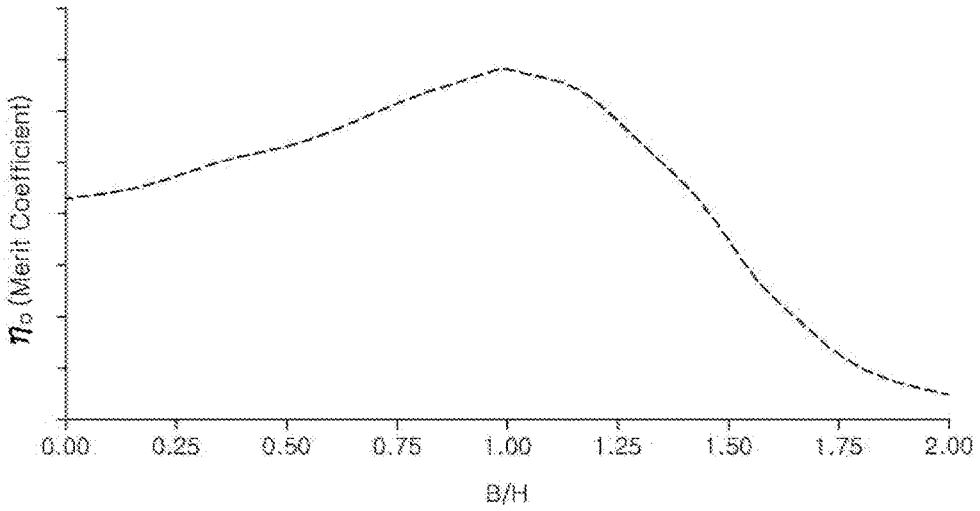
FIG. 12 shows a graph depicting an efficiency change curve depending on ratio (B/H) of the sub-blades in accordance with the second embodiment of the present disclosure.

FIG. 12 shows a graph depicting an efficiency change curve depending on slope ratio B/H of a sub-blade in accordance with the second embodiment of the present disclosure.

In particular, referring to FIG. 12, the slope ratio B/H of a sub-blade 320 in a range from 0.25 to 1.5 may improve thruster efficiency. For example, if the slope ratio B/H of a sub-blade 320 is smaller than 0.25 or greater than 1.5, it is hard to effectively reduce the vortices W left around the hub 200. Therefore, the effect of improved thruster efficiency may be insignificant.

In this case, thruster efficiency $\eta_0$ (Merit Coefficient) may be obtained with the aforementioned Equation 1 in consideration of the performance in towing or positioning conditions, for example, ducted propellers or azimuth-type propellers, as important design conditions.

Figure 13:
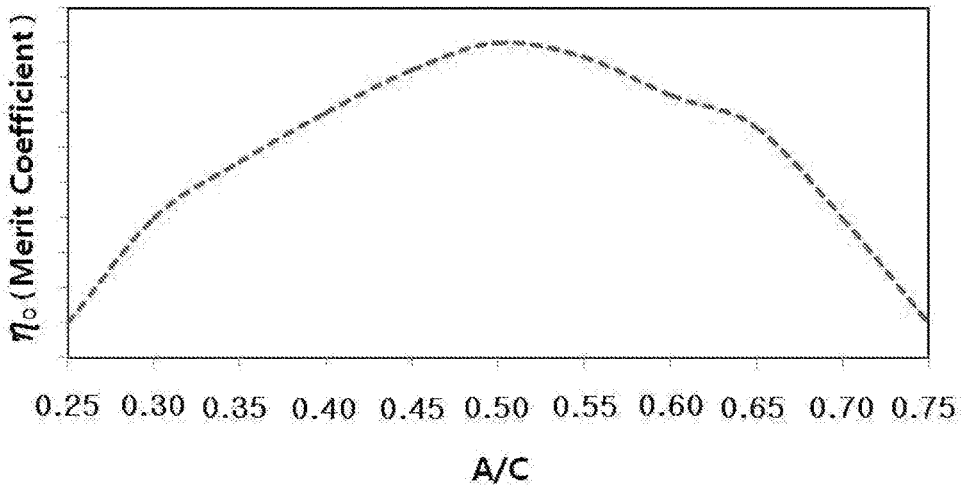
FIG. 13 shows a graph depicting an efficiency change curve depending on the radius ratio (A/C) of the sub-blades in accordance with the second embodiment of the present disclosure.

FIG. 13 shows a graph depicting an efficiency change curve depending on the radius ratio A/C of a sub-blade in accordance with the second embodiment of the present disclosure.

It can be seen from FIG. 13 that the radius ratio A/C of a sub-blade 320 is a rising curve at 0.3, has maximum thruster efficiency at 0.5, and is a sharply falling curve after 0.7.

For example, the radius ratio A/C of the sub-blade 320 in a range from 0.3 to 0.7 may have the effect of optimized thruster efficiency improvement. Referring to FIG. 11, 'A' may be defined as the radius of the sub-blade 320, and 'C' as the full length of the duct 100.

Figure 14:
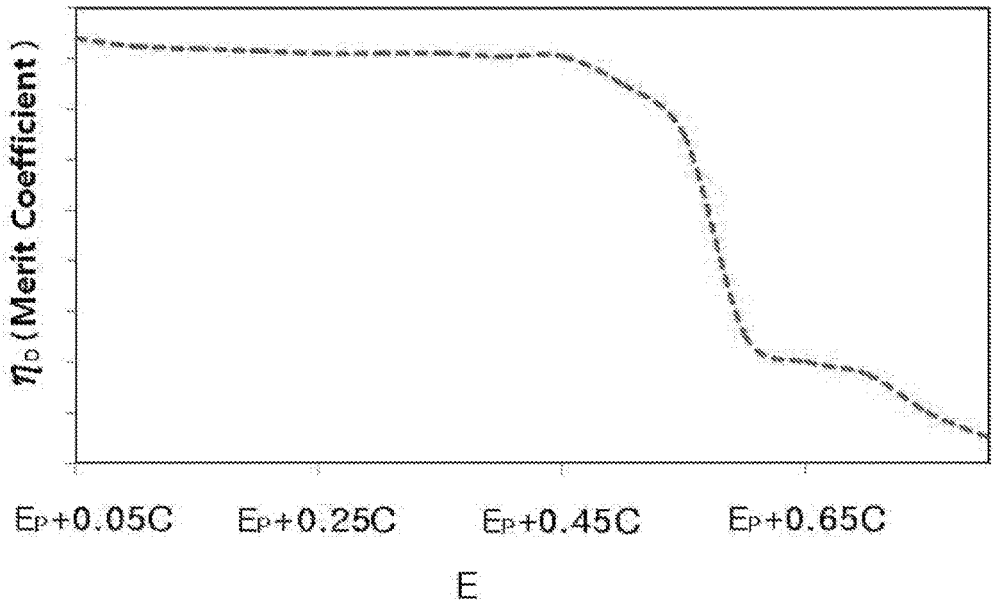
FIG. 14 shows a graph depicting an efficiency change curve depending on the range of the position (E/C) for the sub-blades in accordance with the second embodiment of the present disclosure.

FIG. 14 shows a graph depicting an efficiency change curve depending on the range of sub-blade position E/C in accordance with the second embodiment of the present disclosure.

Referring to FIG. 14, defining the axial direction (the direction of (−) X-axis) distance from the front vertex of the duct 100 to the position of the main blade 310 as $E_P$, it is shown that good performance is implemented when the position E of a sub-blade 320 is in a range (EP~EP+0.5C), which is within 0.5C (i.e., half of the full length of the duct) from the position $E_P$ of the main blade 310 toward the back of the main shaft. That is, the position E along the axial direction (the direction of (−) X-axis) of the sub-blade 320 is a gently falling curve from the main blade position $E_P$ to the position $E_P$+0.5 C toward the back of the main shaft, and then a sharply falling curve. In this case, the position E may be defined as a position of the sub-blade 320 in the X-axis direction. $E_P$ may be defined as a position of the main blade 310 in the X-axis direction, and C as the full length of the duct 100.

Figure 15:
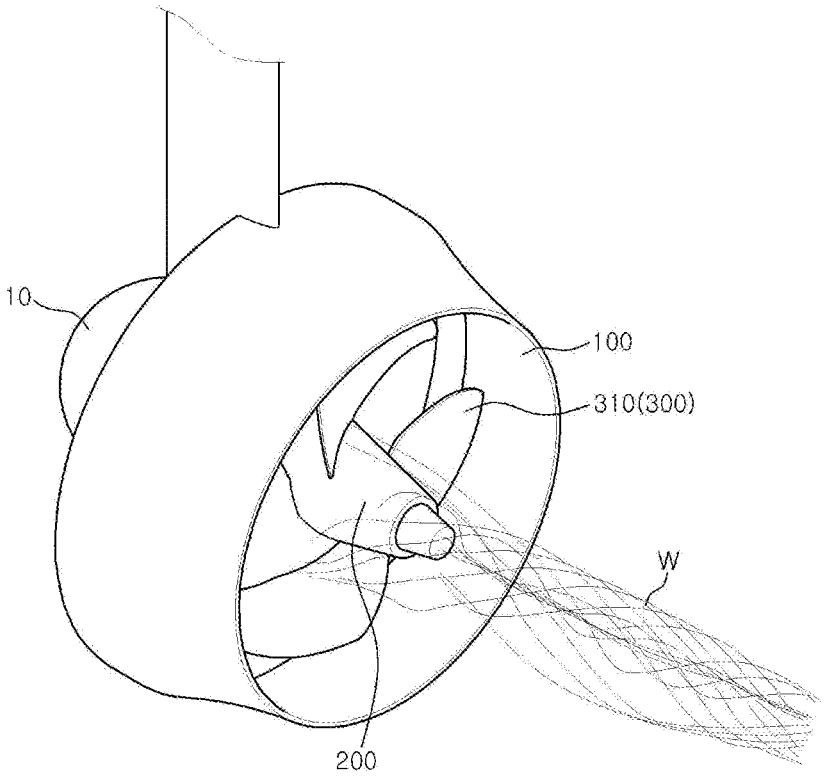
FIG. 15 is a perspective view of a vessel propulsion apparatus in accordance with a comparative example compared with the propulsion apparatus shown in FIG. 8 in order to compare the distribution of second distance K.
Figure 16:
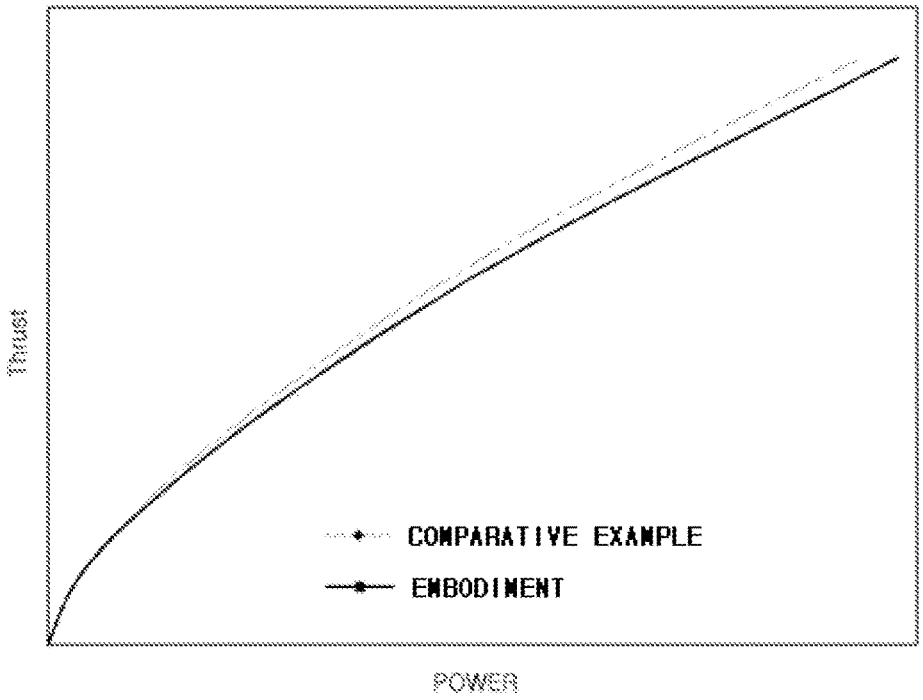
FIG. 16 shows a graph depicting bollard performance curves (POWER-THRUST) for the propulsion apparatus shown in FIG. 8 and the propulsion apparatus shown in FIG. 15.
Figure 17:
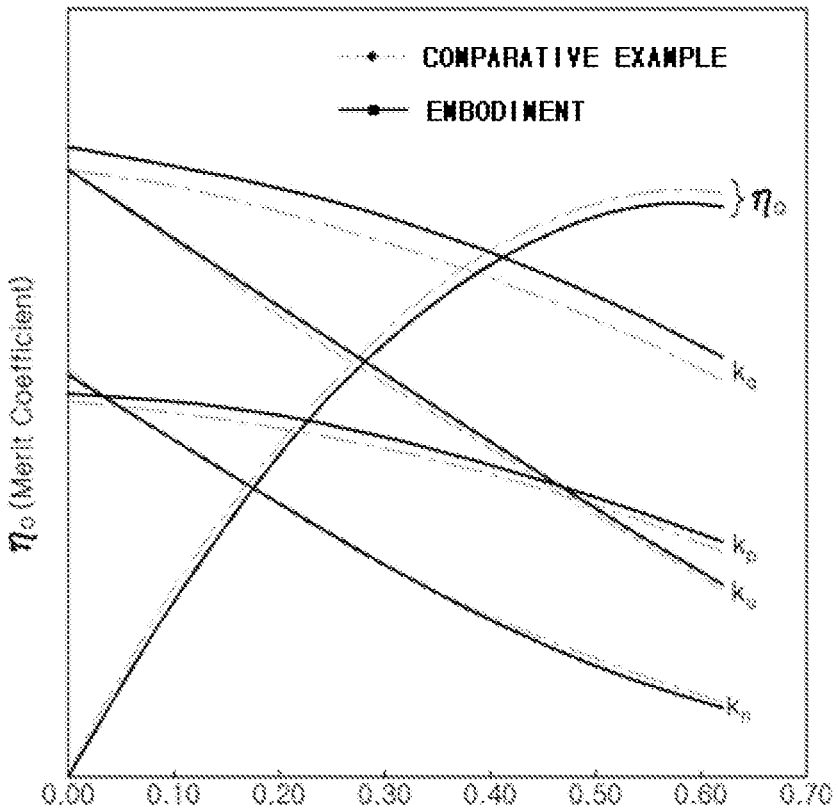
FIG. 17 shows a graph depicting curves for propulsion performance characteristics obtained through water bath test to compare and verify performance of the propulsion apparatus shown in FIG. 8 and the propulsion apparatus shown in FIG. 15.

FIG. 15 shows a perspective view of a vessel propulsion apparatus in accordance with a comparative example compared with the propulsion apparatus shown in FIG. 8 in order to compare the distribution of the second distance K. FIG. 16 shows a graph depicting bollard performance curves (POWER-THRUST) for the propulsion apparatus shown in FIG. 8 and the propulsion apparatus shown in FIG. 15. FIG. 17 shows a graph depicting each curve for propulsion performance characteristics obtained through water bath test to compare and verify performance of the propulsion apparatus shown in FIG. 8 and the propulsion apparatus shown in FIG. 15.

Referring to FIGS. 15 to 17, in order to achieve the comparison of the bollard performance, a marine 19A airfoil was used, which is a duct 100 of the same type as the ducted azimuth thruster as a comparative example. The bollard performance curve (POWER-THRUST) for each airfoil section of this embodiment and the comparative example may be obtained through a model test (water bath test).

As shown in FIG. 15, an examination of vortices W in the propulsion apparatus in accordance with the comparative example, left around the propeller 300 and the hub 200 in the bollard condition reveals that more increased vortices W are found left around the propeller 300 and the hub 200 of the comparative example than in the propulsion apparatus shown in FIG. 8 of this embodiment.

As shown in FIG. 16, an examination of the bollard performance curve (POWER-THRUST) reveals this embodiment provided with the sub-blades 320 improves thrust in the bollard condition by about 4.0% in comparison with the comparative example without the sub-blades 320.

In addition, if the sub-blades 320 are provided as in this embodiment, it is shown that the torque of propeller 300 is reduced across all advance ratios while keeping entire thrust of a thruster.

As shown in FIG. 17, the duct 100 of this embodiment showed reduced torque Kq across all advance ratios J in comparison with the marine 19A airfoil of the comparative example.

In particular, the propulsion apparatus of this embodiment generates about 2.5% more thrust in calculation with the same engine horsepower by using the Kq result in the bollard area at J=0, and improves efficiency $\eta_O$ by 5.0% in the area with the advance ratio J of 0.4 or greater which is a normal operational condition. That is, increased attractive forces of the sub-blade 320 and duct 100 increase flows into the propeller 300, contributing to reducing the torque Kq of the propeller 300 to improve efficiency across all advance ratios J.

As described above, the present disclosure has advantages of improving propulsive efficiency by providing the hub with the main blade and the sub-blade to improve flows around the duct and the propeller, in order to reduce vortices taking place by means of the propeller and also torque required to rotate the propeller. Another advantage of the present disclosure is propulsive efficiency improved through reduced main shaft torque while effectively reducing vortices left around the hub by improving thrust in the bollard condition.

Figure 18:
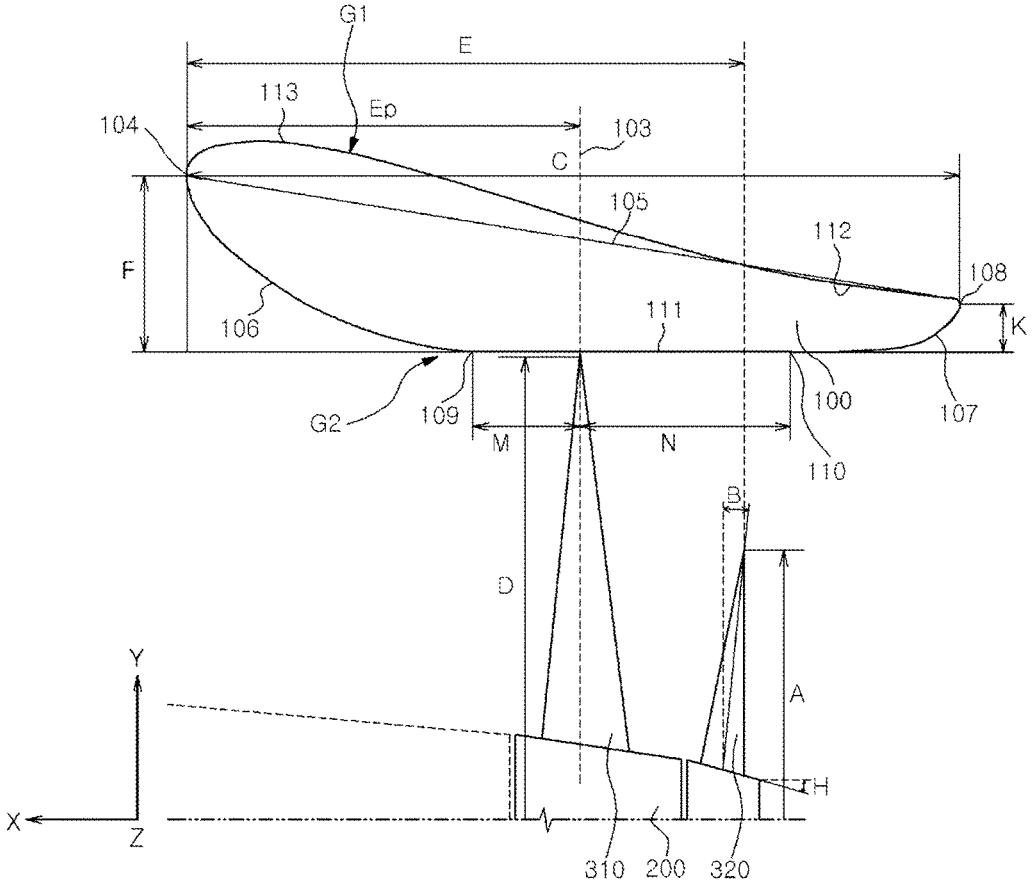
FIG. 18 shows an exemplary duct of a propulsion apparatus in accordance with a third embodiment of the present disclosure.

FIG. 18 shows an exemplary duct of a propulsion apparatus in accordance with a third embodiment of the present disclosure.

Referring to FIG. 18, the duct 100 in accordance with the third embodiment is aligned in the axial direction of the main shaft and installed to surround the hub 200 on the basis of the axial direction (x-axis) of the main shaft. Further, the duct 100 may have the same sectional shape along the entire circumference thereof.

The duct 100 may include an outer surface G1 and an inner surface G2 thereof having optimized design variables to improve the efficiency of ducted propulsion apparatuses in consideration of operation characteristics of vessels, for example, drill ships or marine structures, and characteristics of positioning vessels and towing other vessels immobile in frozen seas.

In particular, in the sectional shape, the duct 100 may include a nose 104 which is a front vertex of the airfoil section, a tail 108 which is a rear vertex of the airfoil section, and a chord line 105 which is a straight line segment connecting the nose 104 with the tail 108. The sectional shape of the duct 100 may include an outer surface G1 having a front portion 113 formed convex above the front end of the chord line 105, and a rear portion 112 formed concave below the back end of the chord line 105.

In this case, the front portion 113 of the outer surface G1 of the duct 100 may be a curved surface from the point where the chord line 105 meets the outer surface G1 of the duct 100 to the nose 104. The rear portion 112 of the outer surface G1 of the duct 100 may be a curved surface from the point where the chord line 105 meets the outer surface G1 of the duct 100 to the tail 108.

The front portion 113 and the rear portion 112 may be seamlessly connected each other at the point where the chord line 105 meets the outer surface G1 of the duct 100. As such, the front portion 113 of the outer surface G1 of the duct 100 is formed convex above the front end of the chord line 105.

As described above, the front portion of the outer surface of the duct 100 convex upward above the chord line may accelerate flows into the propeller 300. This effect of acceleration may improve the thrust of the duct 100 and reduce the torque of the propeller 300. The rear portion 112 of the outer surface G1 of the duct 100 formed concave below the back end of the chord line 105 may enable flows in the rear outer side to smoothly flow into the tail direction of the duct 100 to form vortices around the tail, improving the thrust of duct 100.

Also, in the sectional shape, the duct 100 may include an inner surface G2 of the duct 100 composed of: a parallel portion 111 running parallel with the axial direction (x-axis) of the main shaft; an inner front portion 106 of the duct 100 which is a curved surface gently projected from the start point 109 of the parallel portion 111 to the nose 104 within a range equivalent to a first distance F in the direction of Y-axis from the parallel portion 111 to the nose 104; and an inner rear portion 107 of the duct 100 which is a curved surface gently projected from the end point 110 of the parallel portion 111 to the tail 108 within a range equivalent to a second distance K in the direction of Y-axis from the parallel portion 111 to the tail 108, the second distance being smaller than the first distance F.

In the sectional shape, the duct 100 of this embodiment may include a front portion M of the parallel portion 111 with M/C in a range from −4.0% to 14.0% relative to the full length C from the position of propeller plane 103, and a rear portion N of the parallel portion 111 with N/C in a range from −30.0% to −10.0% relative to the full length C from the position of propeller plane 103.

A constant length of the parallel portion 111 close to the propeller 300 in the duct 100 may enhance efficiency. Therefore, if M/C which is a ratio of the front portion M of the parallel portion 111 relative to the full length C is smaller than −4.0%, or N/C which is a ratio of the rear portion N of the parallel portion 111 relative to the full length C is greater than −10.0%, the parallel portion 111 is too short in length to result in insignificant improvement of efficiency.

In the sectional shape, the duct 100 of this embodiment may include a first distance F with F/C in a range from 18.0% to 30.0% relative to the full length C from the parallel portion 111 to the nose 104, and a second distance K with K/C in a range from 4.0% to 10.0% relative to the full length C from the parallel portion 111 to the tail 108.

While the embodiments of the present disclosure have been described with reference to the accompanying drawings, it will be understood by those skilled in the art that various changes and modifications may be made without changing the scope or essential characteristics of the present disclosure as defined in the following claims. For example, those skilled in the art may change material or size of each component depending on applications, or combine or substitute embodied types into the types not explicitly described in the embodiments of the present disclosure, which are not out of the scope of the present disclosure. Therefore, the embodiments described above are exemplary in all respects, not intended limiting, and the modified embodiments shall be covered by the claims of the present disclosure.

The invention claimed is:

1. A vessel propulsion apparatus comprising:

a hub arranged on and receiving power through a main shaft;

main blades installed on the outer circumferential surface of the hub;

sub-blades spaced from and placed toward the back of the main shaft from the main blades and installed inclined toward the back of the main shaft; and a duct installed around the main blades, the duct having an airfoil section, wherein the sub-blades have a radius ratio A/C ranging from 0.3 to 0.7, in the radius ratio A/C, A representing the radius of the sub-blade, and C representing the full length of the duct.

2. The vessel propulsion apparatus of claim 1, wherein the main blades comprises a plurality of main blades that are spaced and arranged along the outer circumferential surface of the hub; and the sub-blades comprises a plurality of sub-blades that are spaced and arranged alternately with the main blades.

3. The vessel propulsion apparatus of claim 1, wherein the sub-blades have an inclination angle B in a range from 0.1 to 27 degrees toward the back of the main shaft relative to a plane perpendicular to the axial direction of the main shaft.

4. The vessel propulsion apparatus of claim 3, wherein the sub-blades have a slope ratio B/H ranging from 0.25 to 1.5, in the slope ratio B/H, B representing the inclination angle of the sub-blade, and H representing an inclination angle of the outer surface of the hub relative to the axial direction of the main shaft.

5. The vessel propulsion apparatus of claim 1, wherein the sub-blades are positioned in a range of within 0.5 relative to the full length of the duct toward the back of the main shaft from the position of the main blades.

6. The vessel propulsion apparatus of claim 1, wherein the duct comprises a nose as a front vertex of an airfoil section, and a tail as a rear vertex of the airfoil section; and the sectional shape of the duct comprises:

an outer surface formed convex outward at the front end of the duct, and formed concave inward at the back end of the duct; and an inner surface, the inner surface comprising:

an inner front portion of the duct formed convex inward at the front end of the duct;

an inner rear portion of the duct formed convex inward at the back end of the duct; and a parallel portion seamlessly connecting the inner front portion of the duct with the inner rear portion of the duct, the parallel portion running parallel with the rotation axis of the propulsion apparatus.

7. The vessel propulsion apparatus of claim 6, wherein the outer surface comprises:

a front portion formed convex above the front end of a chord line which is a straight line segment connecting the nose with the tail; and a rear portion formed concave below the back end of the chord line.

8. The vessel propulsion apparatus of claim 6, wherein the inner front portion of the duct is a curved surface from a start point of the parallel portion to the nose within a range equivalent to a first distance in the radial direction from the parallel portion to the nose; and the inner rear portion of the duct is a curved surface from an end point of the parallel portion to the tail within a range equivalent to a second distance in the radial direction from the parallel portion to the tail, the second distance being smaller than the first distance.

9. The vessel propulsion apparatus of claim 8, wherein the parallel portion comprises:

a front portion thereof in a range from −4.0% to 14.0% relative to the full length of the duct from the position of a propeller plane, which is a circular plane drawn by the rotating main blades; and a rear portion thereof in a range from −30.0% to −10.0% relative to the full length of the duct from the position of the propeller plane.

10. The vessel propulsion apparatus of claim 8, wherein the sectional shape of the duct comprises:

the first distance in a range from 18.0% to 30.0% relative to the full length of the duct from the parallel portion to the nose; and the second distance in a range from 4.0% to 10.0% relative to the full length of the duct from the parallel portion to the tail.

11. The vessel propulsion apparatus of claim 6, wherein the duct has thruster efficiency obtained with the following Equation:

$$\eta_0 = \frac{(K\pi/\pi)^{3/2}}{K_Q}$$

where $K_\pi = K_{T\ propeller} + K_{T\ duct}$, $$K_{T\ propeller} = \frac{T_P}{\rho \cdot n^2 \cdot D_P^4},$$

$$K_{T\ duct} = \frac{T_D}{\rho \cdot n^2 \cdot D_P^4}, \text{ and}$$

$$K_Q = \frac{Q}{\rho \cdot n^2 \cdot D_P^5}$$

in which $\eta_0$ represents thruster efficiency (Merit Coefficient); $T_P$ does propeller thrust; $T_D$ does duct thrust; Q does propeller torque; $D_p$ does a propeller diameter; n does propeller RPM (Revolutions Per Minute); and ρ does the density of a fluid.

* * * * *